US011624274B2

(12) United States Patent
Tackmann et al.

(10) Patent No.: US 11,624,274 B2
(45) Date of Patent: Apr. 11, 2023

(54) CORRECTION OF GYROSCOPIC MEASUREMENTS FOR DIRECTIONAL DRILLING

(71) Applicants: Gunnar Tackmann, Niedersachsen (DE); Tobias Kischkat, Celle (DE); Thomas Kruspe, Wietzendorf (DE); Peter Rottengatter, Celle (DE)

(72) Inventors: Gunnar Tackmann, Niedersachsen (DE); Tobias Kischkat, Celle (DE); Thomas Kruspe, Wietzendorf (DE); Peter Rottengatter, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/932,095

(22) Filed: Jul. 17, 2020

(65) Prior Publication Data

US 2021/0040839 A1 Feb. 11, 2021

Related U.S. Application Data

(60) Provisional application No. 62/886,734, filed on Aug. 14, 2019, provisional application No. 62/875,784, filed on Jul. 18, 2019.

(51) Int. Cl.
*E21B 47/0228* (2012.01)
*E21B 47/0236* (2012.01)

(52) U.S. Cl.
CPC ..... *E21B 47/0228* (2020.05); *E21B 47/0236* (2020.05)

(58) Field of Classification Search
None
See application file for complete search history.

(56) References Cited

U.S. PATENT DOCUMENTS 4,637,480 A 1/1987 Obrecht et al.
4,649,349 A 3/1987 Chiron et al.
4,909,336 A 3/1990 Brown et al.
(Continued)

FOREIGN PATENT DOCUMENTS

EP 1983154 A1 10/2008
WO 2015054432 A1 4/2015

OTHER PUBLICATIONS

International Preliminary Report on Patentability for International Application No. PCT/US2020/042536; dated Jan. 18, 2022; 6 pages.

*Primary Examiner* — Douglas X Rodriguez
(74) *Attorney, Agent, or Firm* — Cantor Colburn LLP

(57) ABSTRACT

A method of estimating a directional parameter of a downhole component includes deploying a borehole string in a borehole, the borehole string including the downhole component, the downhole component being rotatable, the downhole component including a gyroscope device and a magnetometer device. The method also includes collecting gyroscope measurement data from the gyroscope device and magnetic field measurement data from the magnetometer device during rotation of the downhole component, and estimating, by a processor, the directional parameter of the downhole component, where the estimating includes correcting the gyroscope measurement data based on the magnetic field measurement data.

24 Claims, 6 Drawing Sheets

(56) References Cited

U.S. PATENT DOCUMENTS

| | | | | |
|---|---|---|---|---|
| 6,484,819 | B1 | 11/2002 | Harrison | |
| 6,529,834 | B1 | 3/2003 | Estes et al. | |
| 7,114,565 | B2 | 10/2006 | Estes et al. | |
| 7,813,878 | B2 | 10/2010 | Estes et al. | |
| 8,487,626 | B2 | 7/2013 | Khan et al. | |
| 8,827,006 | B2 | 9/2014 | Moriarty | |
| 8,874,407 | B2 | 10/2014 | Miszewski et al. | |
| 9,417,335 | B2 | 8/2016 | Sinclair et al. | |
| 9,464,519 | B2 | 10/2016 | Liu et al. | |
| 9,863,783 | B1 | 1/2018 | Ledroz | |
| 9,926,779 | B2 | 3/2018 | Sugiura | |
| 10,202,841 | B2 | 2/2019 | Zhang et al. | |
| 2001/0041963 | A1* | 11/2001 | Estes | G01C 19/38 702/6 |
| 2004/0222019 | A1* | 11/2004 | Estes | G01V 5/04 175/45 |
| 2005/0056461 | A1 | 3/2005 | Estes et al. | |
| 2009/0089001 | A1 | 4/2009 | Lin | |
| 2014/0102795 | A1* | 4/2014 | VanSteenwyk | G01V 3/081 175/45 |
| 2016/0177704 | A1 | 6/2016 | Van Steenwyk | |
| 2018/0051551 | A1* | 2/2018 | Jeffryes | E21B 47/024 |
| 2018/0364389 | A1* | 12/2018 | Ledroz | G01V 3/40 |
| 2019/0169979 | A1* | 6/2019 | Nguyen | E21B 47/022 |

* cited by examiner

CORRECTION OF GYROSCOPIC MEASUREMENTS FOR DIRECTIONAL DRILLING

CROSS REFERENCE TO RELATED APPLICATIONS

This application claims the benefit of U.S. Provisional Application Serial No. 52/875,784 filed on Jul. 18, 2019 and U.S. Provisional Application Ser. No. 62/886,734 filed on Aug. 14, 2019, the disclosures of which are incorporated herein by reference in their entirety.

BACKGROUND

Various types of drill strings are deployed in a borehole for exploration and production of hydrocarbons. A drill string generally includes drill pipe or other tubular and a bottomhole assembly (BHA). Many drilling operations utilize directional measurements in conjunction with a steering assembly or system to direct a borehole along a desired path, e.g., to target specific formations or productive subterranean regions. One such steering assembly is referred to as a rotary steerable system.

SUMMARY

An embodiment of a method of estimating a directional parameter of a downhole component includes deploying a borehole string in a borehole, the borehole string including the downhole component, the downhole component being rotatable, the downhole component including a gyroscope device and a magnetometer device. The method also includes collecting gyroscope measurement data from the gyroscope device and magnetic field measurement data from the magnetometer device during rotation of the downhole component, and estimating, by a processor, the directional parameter of the downhole component, where the estimating includes correcting the gyroscope measurement data based on the magnetic field measurement data.

An embodiment of a system for estimating a directional parameter of a downhole component includes a borehole string, the borehole string comprising the downhole component, the downhole component being rotatable, the downhole component including a gyroscope device and a magnetometer device. The system also includes a a processor configured to collect gyroscope measurement data from the gyroscope device and magnetic field measurement data from the magnetometer device during rotation of the rotatable downhole component, and estimate the directional parameter of the downhole component, where the estimating includes correcting the gyroscope measurement data based on the magnetic field measurement data.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
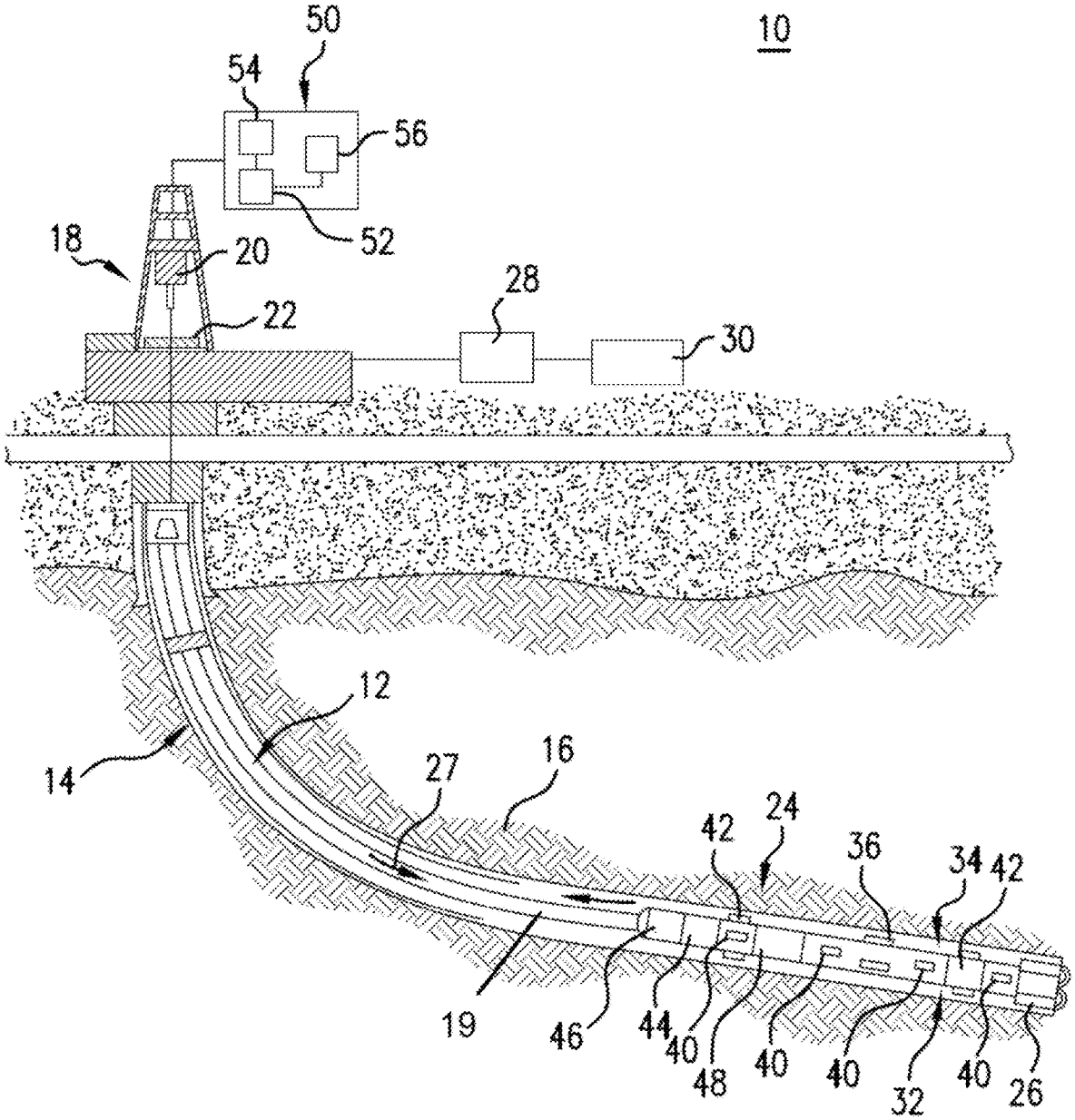
FIG. 1 depicts an embodiment of a drilling and steering system.

Methods, systems and apparatuses for estimating borehole and/or component position and orientation are described herein. An embodiment of a directional measurement system is configured to acquire measurement data from a gyroscope device for use in estimating directional parameters such as toolface orientation ("toolface"), true north and/or azimuth. A magnetometer device also acquires measurement data relating to magnetic field measurements. The gyroscope device and the magnetometer device may be disposed in a fixed rotational relationship to a rotating downhole component, such as a sub-component of a directional survey assembly or in an independently rotating sleeve of a steering assembly.

In one embodiment, the directional measurement system includes a "magnetometer device" for taking (earth) magnetic field related measurements and a "gyroscope device" for taking measurements related to the earth rotational rate (the "earth rate"). A magnetometer device may refer to a single magnetometer or multiple magnetometers. For example, the magnetometer device can include magnetometers (magnetic field sensors) oriented at different directions, for example, as a two-axis or three-axis device (e.g., an x-magnetic field sensor, a y-magnetic field sensor, and/or a z-magnetic field sensor). The different directions of the magnetometers in the magnetometer device may be orthogonal to each other. The directional measurement system is configured to estimate a magnetic toolface based on the magnetometer measurement data, and estimate a gyroscope toolface based on the gyroscope measurement data. The magnetic toolface and the gyroscope toolface are combined to estimate a gyro-to-magnetic toolface offset, which can be used to determine parameters including true north.

In one embodiment, the directional measurement system includes an "accelerometer device" for taking gravity-related measurements, which may be disposed in a fixed rotational relationship to the rotating downhole component. An accelerometer device may refer to a single accelerometer or multiple accelerometers. For example, the accelerometer device can include accelerometers (gravitational field sensors) oriented at different directions, for example, as a two-axis or three-axis device (e.g., an x-accelerometer sensor, a y-accelerometer sensor, and/or a z-accelerometer sensor). The different directions of the accelerometers in the accelerometer device may be orthogonal to each other. Magnetic field measurements may be used to correct accelerometer measurements. The accelerometer measurements may be combined with the magnetic and gyroscope measurements to estimate directional parameters including true north toolface, azimuth and inclination.

As described herein, the "gyroscope device" may refer to a single gyroscope or multiple gyroscopes. For example, the gyroscope device can include gyroscope sensors oriented at different directions, for example, as a two-axis or three-axis device (e.g., an x-gyroscope sensor, a y-gyroscope sensor, and/or a z-gyroscope sensor). The different directions of the gyroscope sensors in the gyroscope device may be orthogonal to each other. Multiple gyroscope devices may be positioned at different locations, such as a different circumferential locations and/or different axial locations along a borehole string. Similarly, the magnetometer device may include multiple magnetometer sensors and the accelerometer device may include multiple accelerometer sensors. The magnetometer device, the accelerometer device and the gyroscope device may be positioned at different locations, such as a different circumferential locations and/or different axial locations along the borehole string.

Embodiments described herein provide a number of advantages and technical effects. For example, the embodiments allow for effective use of gyroscopes in rotating gyroscope devices or rotating sensor packages. A sensor package or sensor assembly may be formed from gyroscope and magnetometer sensors, from gyroscope and accelerometer sensors, or from gyroscope, magnetometer and accelerometer sensors. A package may include at least one senor of each type (gyroscope, magnetometer, accelerometer). Typically, vibrations and rotational movement of a gyroscope can significantly affect the accuracy of gyroscope measurements. Typical measurement systems using gyroscopes are operated in a stand-still (no rotation, no linear movement (x-y direction or z direction) or sliding mode (no rotation). Embodiments described herein broaden the applicability of gyroscopic sensors by addressing the problems encountered in typical systems and allowing for effective use of gyroscopes during rotational modes of a borehole string. The embodiments also allow for gyroscope measurements while drilling, without bulky and power-consuming indexing mechanisms and motors or bulky suspension systems, and without requiring a perfectly non-magnetic environment.

FIG. 1 shows an embodiment of system 10 for performing an energy industry operation (e.g., drilling, measurement, stimulation and/or production). The system 10 includes a borehole string 12 that is shown disposed in a well or borehole 14 that penetrates at least one earth formation 16 during a drilling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials (e.g. geological material) that may be encountered in a subsurface environment and surround the borehole 14.

The borehole string 12 is operably connected to a surface structure or surface equipment such as a drill rig 18, which includes or is connected to various components such as a surface drive 20 (also referred to as top drive) or rotary table 22 for supporting the borehole string 12, rotating the borehole string 12 and lowering string sections or other downhole components. In one embodiment, the borehole string 12 is a drill string including one or more drill pipe sections 19 that extend downward into the borehole 14, and is connected to one or more downhole components (downhole tools), which may be configured as a bottomhole assembly (BHA) 24.

The BHA 24 includes a drill bit 26, which in this embodiment is driven from the surface, but may be driven from downhole, e.g., by a downhole mud motor. The system 10 may include components to facilitate circulating fluid 27 such as drilling mud through an inner bore of the borehole string 12 and an annulus between the borehole string 12 and the borehole wall. For example, a pumping device 28 is located at the surface to circulate the fluid 27 from a mud pit or other fluid source 30 into the borehole 14 as the drill bit 26 is rotated.

In the embodiment of FIG. 1, the system 10 includes a steering assembly 32 configured to steer or direct a section of the borehole string 12 and the drill bit 26 along a selected path. The steering assembly 32 may have any configuration suitable to direct or steer the drill string 12. Examples of steering assemblies include steerable motor assemblies (e.g., bent housing motor assemblies), whipstocks, turbines and rotary steerable systems.

In one embodiment, the steering assembly 32 is configured as a rotary steering assembly forming the BHA 24 or part of the BHA 24. The steering assembly 32 includes a non-rotating or slowly-rotating sleeve 34 that includes one or more radially extendable pads 36 (extendable in a direction perpendicular to a longitudinal axis of the sleeve). The pads 36 are located at different circumferential locations on the sleeve 34 and are adjustable in combination to deflect the drill bit 26 by engaging the borehole wall.

The system 10 also includes a controller configured to operate the pads 36 based on directional information derived from directional sensors located in the borehole string 12. The directional sensor may be at or near the steering assembly. The directional sensors include one or more gyroscopes (gyroscope sensors or earth rate sensor sensors), and also include one or more magnetometers (magnetic field sensors) and/or one or more accelerometers (acceleration sensors).

In one embodiment, the system 10 includes one or more sensor assemblies 40 configured to perform measurements of parameters related to the position and/or direction of the borehole string 12, drill bit 26, or the steering assembly 32. As shown in FIG. 1, the sensor assemblies 40 may be located at one or more of various locations, such as on the non-rotating or slowly-rotating sleeve 34, at or near the drill bit 26 and/or on other components of the borehole string 12 and/or BHA 24. For example, a sensor assembly 40 can be located on one or more stabilizer sections 42 of the steering assembly 32. The non-rotating or slowly-rotating sleeve 34 may be coupled to the borehole string 12 by a bearing assembly or other mechanism that allows rotation of the sleeve independent of the rotation of the borehole string.

The system 10 may include one or more of various tools or components configured to perform selected functions downhole such as performing downhole measurements (e.g., formation evaluation measurements, directional measurements), facilitating communications (e.g., mud pulser, wired pipe communication sub), providing electrical power and others (e.g., mud turbine, generator, battery, data storage device, processor device, modem device, hydraulic device). For example, the steering assembly can be connected to sensor devices such as a gamma ray imaging tool 44.

In one embodiment, the system includes a measurement device such as a logging while drilling (LWD) tool 46 (e.g., for formation evaluation measurements) or a measurement while drilling (MWD) tool (e.g., for directional measurements). Examples of LWD tools include nuclear magnetic resonance (NMR) tools, resistivity tools, gamma (density) tools, pulsed neutron tools, acoustic tools and various others. Examples of MWD tools include tools measuring pressure, temperature, or directional data (e.g., magnetometer, accelerometer, gyro). The steering assembly 32 or the system 10 can include other components, such as a telemetry assembly (e.g., mud pulser, wired pipe communication sub).

In one embodiment, during drilling, the sleeve 34 does not rotate or rotates at a rate that is less than the rotational rate of the drill bit 26 and other components of the steering assembly 32 and rotary table 22 or surface drive 20. The rate of rotation of the sleeve is denoted herein as "slow rotation." It is noted that "slow" rotation is intended to indicate a rotational rate that is less than the drilling rotational rate, and is not intended to be limiting to any specific rate. A "slowly-rotating" sleeve is a sleeve that rotates at the slow rotation rate.

The sleeve 34 can rotate at any suitable slow rotation rate that is less than the drilling rotation rate. In one embodiment, slow rotation of the sleeve 34 is a rate between about 1 and 10 revolutions per hour (RPH). In one embodiment, slow rotation is between about 10 and 50 RPH (60°/minute and 300°/minute). In yet another embodiment, slow rotation is about 1 and 50 RPH (6°/minute and 300°/minute).

One or more downhole components and/or one or more surface components may be in communication with and/or controlled by a processor such as a downhole processor 48 and/or a surface processing unit 50. The surface processing unit 50 (and/or the downhole processor 48) may be configured to perform functions such as controlling drilling and steering, controlling the flow rate and pressure of borehole fluid, controlling weight on bit (WOB), and controlling rotary speed (RPM) of rotary table 22 or surface drive 20, transmitting and receiving data, processing measurement data, and/or monitoring operations of the system 10. The surface processing unit 50, in one embodiment, includes an input/output (I/O) device 52 (such as a keyboard and a monitor), a processor 54, and a data storage device 56 (e.g., memory, computer-readable media, etc.) for storing data, models and/or computer programs or software that cause the processor to perform aspects of methods and processes described herein.

In one embodiment, the surface processing unit 50 is configured as a surface control unit which controls various parameters such as rotary speed, weight-on-bit, fluid flow parameters (e.g., pressure and flow rate) and others. The downhole processor 48 may be a directional measurement controller or other processing device that controls aspects of operating the sensor assemblies 40, acquiring measurement data and/or estimating directional parameters. The downhole processor 48 may also include functionality for controlling operation of the steering assembly 32 and/or other downhole components. In one embodiment, the method and processes described herein may be performed in the downhole processor 48 located within the bore string 12.

In the embodiment of FIG. 1, the system 10 is configured to perform a drilling operation and a downhole measurement operation, and the borehole string 12 is a drill string. However, embodiments described herein are not so limited and may have any configuration suitable for performing an energy industry operation that includes or can benefit from directional measurements (e.g., completion operation, fracturing operation, production operation, or re-entry operation).

Figure 2:
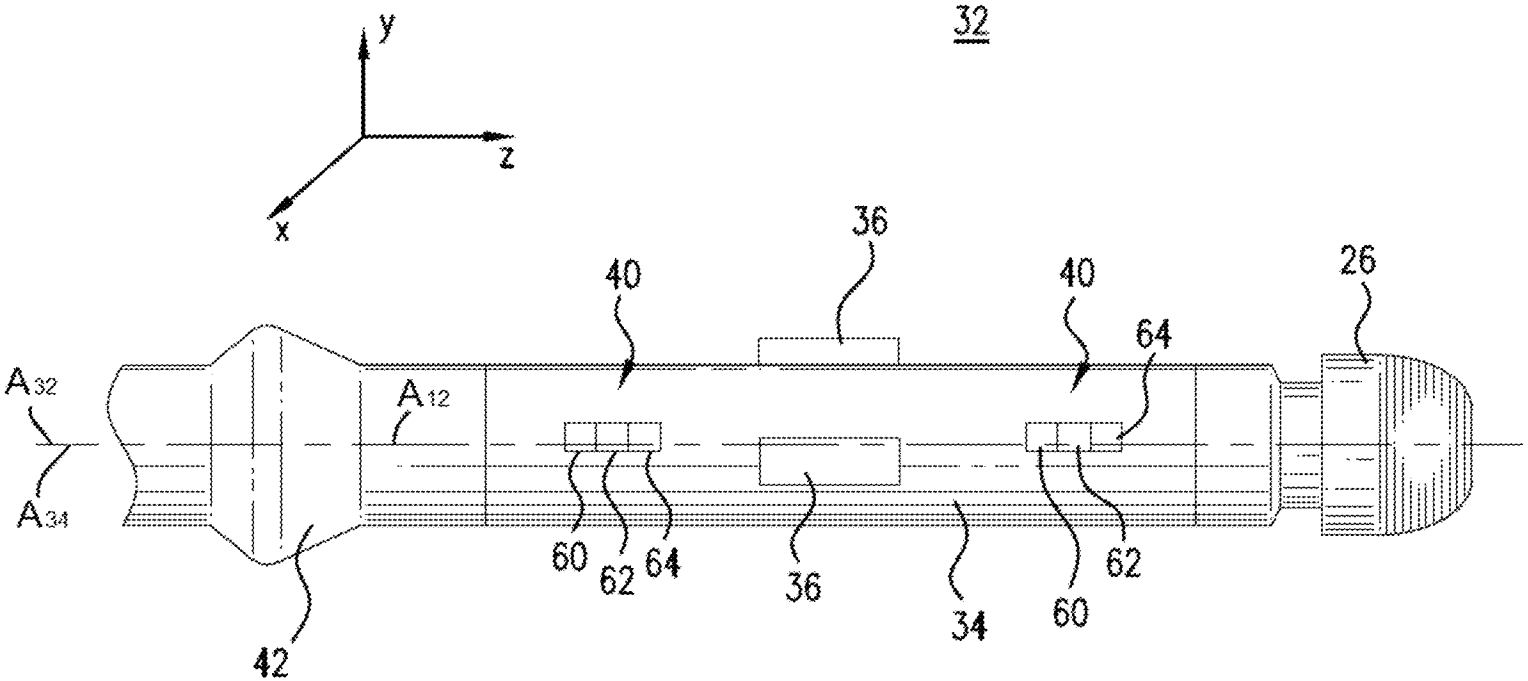
FIG. 2 depicts components of a steering assembly and sensor assemblies according to an embodiment.

FIG. 2 shows an embodiment of the steering assembly 32 and components of a system for monitoring and estimating directional parameters (e.g., azimuth, inclination, tool face, etc.). The steering assembly 32 includes one or more sensor assemblies 40. In this embodiment, the sensor assemblies 40 are disposed on and fixed relative to the sleeve 34, so that the sensor assemblies 40 rotate with the sleeve 34. However, as noted above, the steering assembly 32 and/or the BHA 24 may include any number of sensor assemblies 40 disposed at any suitable location. The one or more sensor assemblies 40 may include only one sensor, such as a gyroscope, an acceleration sensor or a magnetometer sensor, or alternatively, multiple sensors, such as multiple gyroscopes, multiple accelerometers, or multiple magnetic sensors. The one or more sensor assemblies 40 may include multiple sensors of different types, such as a gyroscope and an accelerometer, a gyroscope and a magnetometer, or a gyroscope and a magnetometer and an accelerometer.

The sensor assemblies 40, in this embodiment, each include a gyroscopic measurement device or gyroscope device 60, an accelerometer device 62 and a magnetometer device 64. The gyroscope device 60 measures angular velocity relative to its inertial position (corresponding to the orientation axis) and can be used to determine parameters including true north and the earth rate.

The gyroscope device 60 may be of any suitable type, such as a MEMS gyroscope, mechanical gyroscope and/or fiber optic gyroscope. The accelerometer device 62 may be any suitable type, such as a MEMS accelerometer, a piezoelectric accelerometer, a strain gauge based accelerometer, or Silicon accelerometer. The magnetometer device 64 may be any suitable type, such as a fluxgate magnetometer, induction based magnetometers, Faraday magnetometers, Kerr magnetometers, or magnetostriction magnetometers.

The gyroscope device 60 can include a single axis gyroscope, a two-axis gyroscope or a three-axis gyroscope. A two- or three-axis-gyroscope may be an assembly of two or three single axis gyroscopes. The two axes of the two-axis-gyroscope or the three axes of the three-axis-gyroscope, in one embodiment, are be orthogonal to each other. In other embodiments, the two axes of the two-axis-gyroscope or the three axes of the three-axis-gyroscope may define angle(s) that are different to 90 degree (i.e., not orthogonal), but are not parallel to each other. In one embodiment, the three axes of the three-axis-gyroscope may have an angle different than 90 degrees to each other and there exists no plane comprising all three axes. Likewise, the magnetometer device 64 can include a single-axis, two-axis or three-axis magnetometer, and the accelerometer device 62 can include a single-axis, two-axis or three-axis accelerometer. A two- or three-axis-accelerometer or magnetometer may be an assembly of two or three single axis accelerometers or magnetometers. The axes of the accelerometer assembly or magnetometer may have orientations that are the same as or similar to the orientations of the gyroscope assembly as described earlier in this paragraph.

For example, as shown in FIG. 2, the axes are a z-axis parallel to a longitudinal axis $A_{32}$ of the steering assembly 32 or parallel to the longitudinal axis $A_{12}$ of the borehole string 12, and x- and y-axes orthogonal to the z-axis. The x and y coordinates are parallel to the x-y-steering-assembly-plane. The x-y-steering-assembly-plane in the steering assembly 32 is perpendicular to the z-axis or longitudinal axis $A_{32}$ of the steering assembly 32. The longitudinal axis $A_{34}$ of the sleeve coincides with the axis $A_{32}$. The x-y-borehole-string-plane is perpendicular to the z-axis or longitudinal axis of the borehole string 12. If the borehole string is not curved and/or there is no sag, x-y-borehole-string-plane and x-y-steering-assembly-plane are parallel to each other.

The sensor assemblies 40 (and a processing device such as the downhole processor 48) form part of a directional measurement system that utilizes measurement data from the sensor assemblies to estimate directional parameters, such as toolface, inclination and azimuth. The system may also estimate parameters related to a direction, such as the earth rotational rate (the earth rate) and true north, true east, magnetic north, magnetic east, highside and lowside (gravity).

Gyroscopes are challenged by environmental vibration, which typically requires that measurements taken using a gyroscope are taken during a non-rotating state (stand-still or sliding state). Furthermore, gyroscopes typically have high biases that compromise an accurate directional measurement in north finding mode. This is typically overcome using an indexing mechanism that rotates the input axis of the gyroscope and alternates the measured signal, which allows for bias removal. However, such mechanisms are bulky and complex. In addition, perturbations of directional measurements, due to strong vibration (e.g., lateral vibration, axial vibration, or torsional vibration (such as high frequency torsional vibration (HFTO)), magnetic interference (magnetometer) or misalignment of the BHA 24 or steering assembly 32 in the borehole 14 (so-called sag), can lead to failed readings and hence failed surveys. Magnetic interference is caused by either magnetic material in the drill string 12, magnetic material in the geological formation 16, or magnetic material in a nearby borehole.

The directional measurement system is configured to utilize magnetometer measurements to correct gyroscope measurements, to reduce errors due to bias and noise from, e.g., component rotation and vibration. In one embodiment, gyroscope measurements are combined with magnetometer measurements to adjust toolface orientation, which can be used to estimate true north and azimuth. The measurement system can also use magnetometer measurements to estimate speed of rotation of the sleeve 34 for noise removal. In one embodiment, accelerometer measurements are combined with magnetometer measurements to reduce or eliminate errors due to lateral, axial, or torsional vibrations.

In order to overcome directional measurement perturbations dependent on sensor position, several sensor assemblies 40 can be placed within differential axial positions along the steering assembly 32 and/or the borehole string 12. This allows for the cross-check of signal quality of different assemblies 40. If a match of multiple assemblies 40 is assured, the modeled error of the directional measurements and uncertainty of borehole position can be reduced. Cross checks can be based on total earth rate, total earth magnetic field and total gravitational field (QCing).

Magnetometer measurements, in one embodiment, are used to track the magnetic toolface orientation over a limited duration in order to provide magnetic toolface information, which can be used to filter signals from accelerometer and/or gyroscope data. In case the magnetometer measurements are not significantly perturbed by magnetic interference, magnetometer measurements can be used with both accelerometer and gyroscope readings to derive an overall directional measurement.

Figure 3:
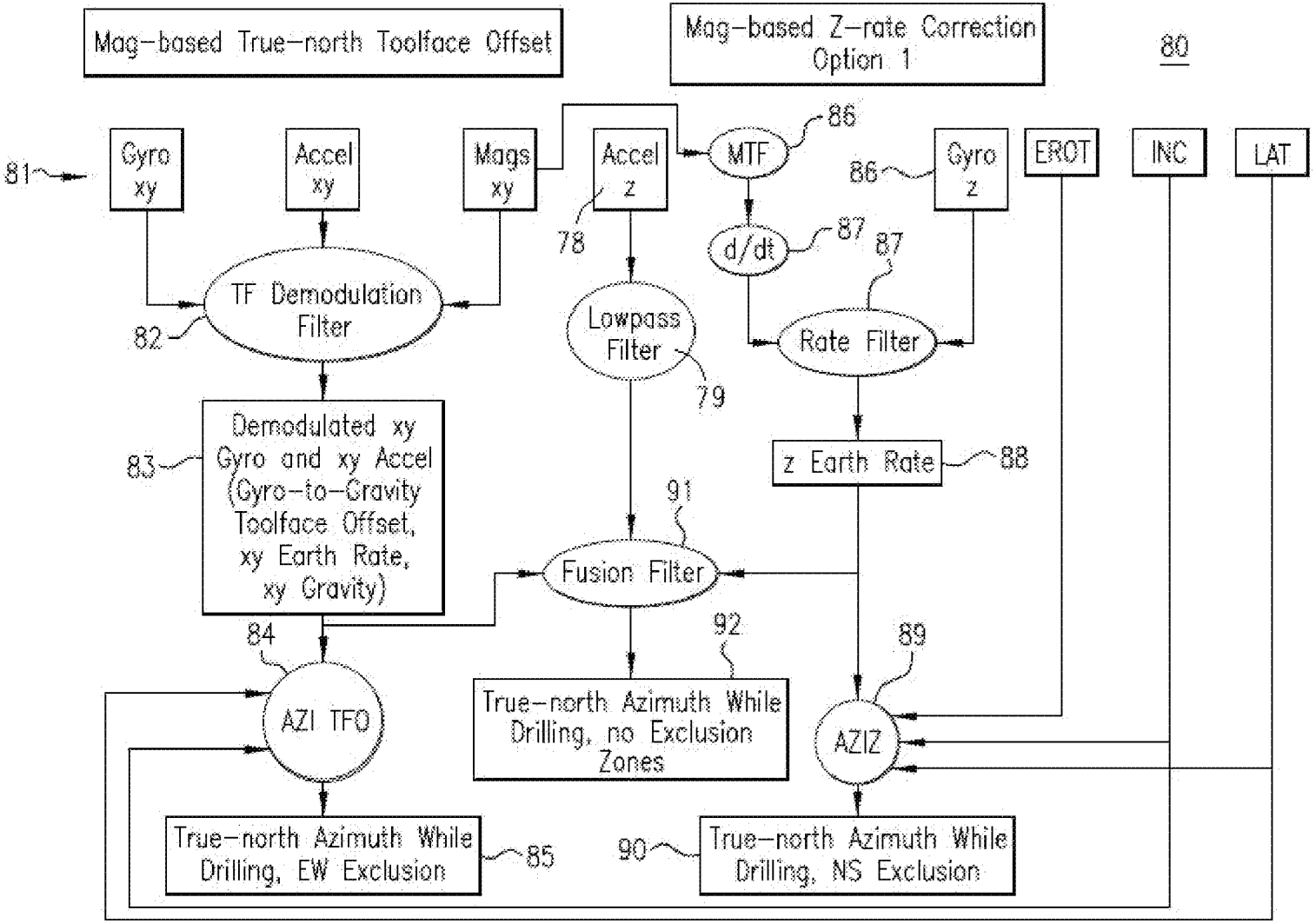
FIG. 3 is a flow chart that depicts an embodiment of a method of estimating position and directional parameters of a downhole component, which includes correcting gyroscope measurements using magnetometer measurements.

FIG. 3 depicts an embodiment of a method 80 of estimating directional parameters of a downhole component. The method 80 is described in conjunction with a sensor assembly 40 and the steering assembly 32, but is not so limited. The method 80 includes a plurality of method steps or stages, represented by blocks 81-92. The method 80 may include all of the stages or steps in the order described. However, certain stages or steps may be omitted, stages may be added, or the order of the stages changed.

Figure 4:
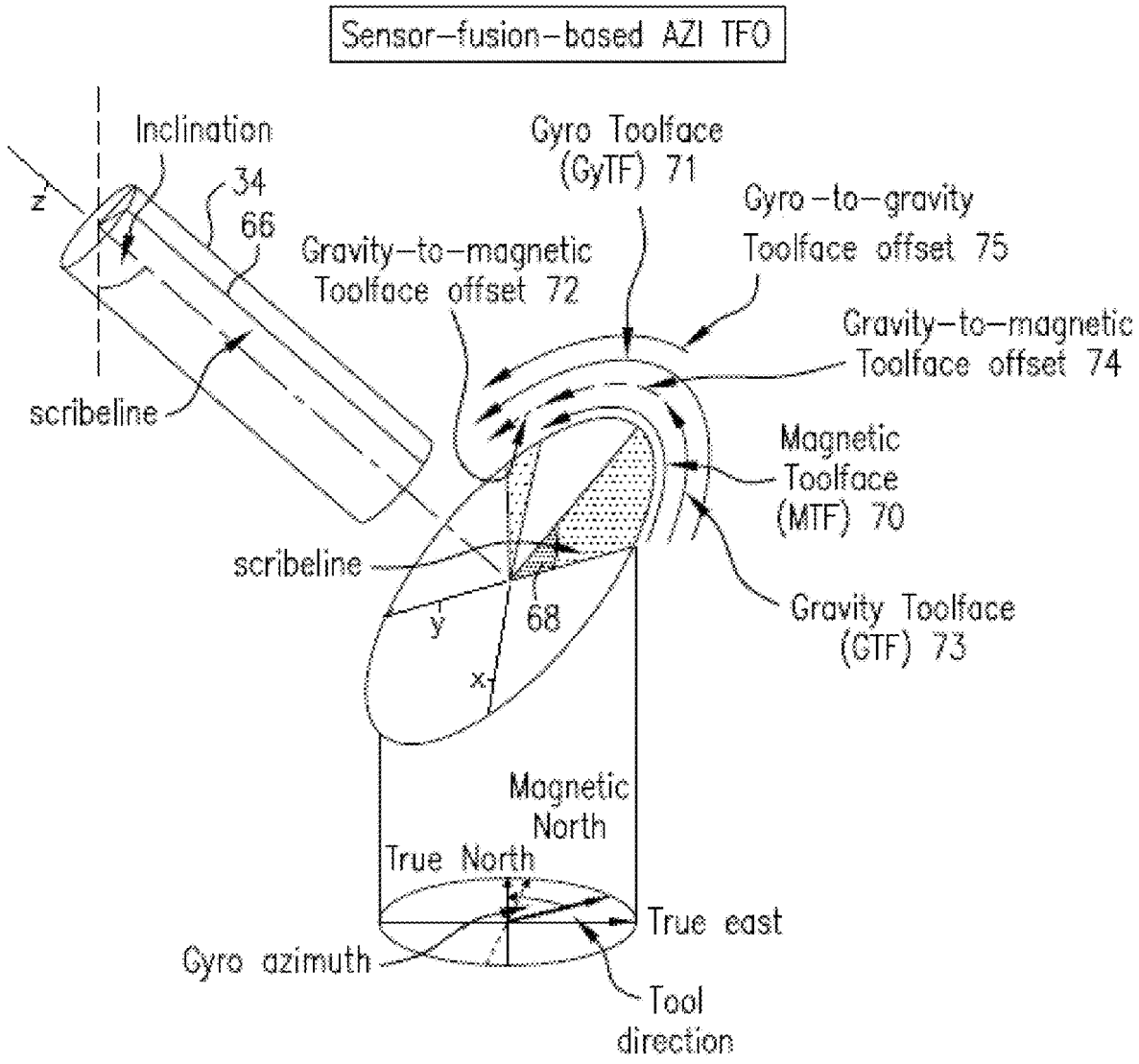
FIG. 4 depicts an example of a downhole component and illustrates various directional measurements according to one or more embodiments.

The method 80 is discussed in conjunction with FIG. 4, which illustrates various measurements and directional parameters estimated or derived as described below. FIG. 4 shows an example of an inclination of a downhole component such as the sleeve 34 relative to a scribeline 66. The various toolface measurements and offsets are exemplified as angular values relative to an angular position of the scribeline 66, shown as a scribeline reference angle 68, in a x-y plane orthogonal to the axis of the sleeve 34 (the z-axis).

At block 81, measurements are performed by the gyroscope device 60, by the magnetometer device 64, and by the accelerometer device 62. In one embodiment, the measurements are performed during a slow rotation mode of the borehole string 12, the sleeve 34 and/or the steering assembly 32. For example, measurements are performed by a sensor assembly 40 on the sleeve 34, which rotates in a slow rotation mode during drilling. In another example, measurements are performed by sensor assemblies 40 on other components of the borehole string 12 during periods when rotation (e.g., driven from the surface) is reduced to a slow rotation mode. In one embodiment, the gyroscope device 60, the accelerometer device 62 and the magnetometer device 64 are all configured to measure in three axes (x, y and z-axes). The sensor assembly 40 may be located inside the sleeve 34 (e.g., inside a hatch), in the collar of a collar-based downhole tool (e.g., inside a hatch), or inside a device container inside the inner bore of a downhole tool (e.g., a probe-based downhole tool).

In alternative embodiments, the sensor assembly 40 may be located along the borehole string 12 in a wired pipe string. In the wired pipe string, each drill pipe may contain a sensor assembly.

The sensor assembly may be located at a radial distance D (not shown) from the rotational axis of the sleeve 34 or the rotational axis of the borehole string 12. The rotational axis of the sleeve 34 and the rotational axis of the borehole string 12 is parallel to the longitudinal axis $A_{32}$ and the longitudinal axis $A_{12}$, in one embodiment. The z-axis as shown in FIG. 2 and FIG. 4 may be parallel to the rotational axis or the sleeve 34 or the rotational axis of the borehole string 12, depending on where the sensor assembly 40 is located.

The measurements may be performed on a slow rotating device as discussed above. In one embodiment, the measurements can be performed during other rotation speeds. For example, measurements can be taken on a component rotating at typical drill rotation speeds (e.g., up to about 10 revolutions per second, or higher).

In one embodiment, the measurement data of the different sensor types (gyroscope, magnetometer and accelerometer) are representative of the same time interval or have overlapping time intervals, and provide the same time resolution. If sample rates are different between different sensor types, data may be conditioned to provide the same time resolution. It may be assumed that the different sensor types have the same rotational axis. That is, no sag exists along the borehole string or sleeve between z-positions of the sensors.

At block 82, data from x- and y-axis magnetometer measurements (referred to as "Mags-x-y" measurements or data) are used to estimate the magnetic toolface orientation or magnetic toolface (MTF) 70 at a selected time during rotation, which is used to correct x- and y-axis gyroscope measurement data (referred to as "Gyro-x-y" measurements or data). These measurements are combined to determine a difference or offset between the magnetic toolface 70 derived from the Mags-x-y data and toolface 71 at the selected time as derived from the Gyro-x-y data (the "gyro toolface" or "GyTF" 71). This offset is referred to as a "gyro-to-magnetic toolface offset" 72.

In one embodiment, the Mags-x-y data is used to correct errors in accelerometer measurements due to, e.g., vibrations. For example, x- and y-axis accelerometer measurements (referred to as "Accel-x-y" measurements or data) are used to estimate the toolface 73 at the selected time, referred to herein as the "gravity toolface" or "GTF" 73. The MTF 70 and the GTF 73 are combined to estimate a gravity-to-magnetic toolface offset 74.

In one embodiment, the Accel-x-y and the Mags-x-y data are input to a toolface demodulation filter (TF demodulation filter) at block 82, which outputs the combined gravity-to-magnetic toolface offset 74 between the magnetic toolface 70 and the gravity toolface 73.

In one embodiment, the Gyro-x-y and the Mags-x-y data are input to a toolface demodulation filter at block 82, which outputs the combined offset 72 between the magnetic toolface 70 and the gyro toolface 71, i.e., the gyro-to-magnetic toolface offset 72.

In one embodiment, the toolface demodulation filter at block 82 is implemented as a synchrodyne demodulator or a Zero IF demodulator. The magnetometer (Mags-x-y) data is used as a synchronous demodulation frequency for detecting the amplitude of accelerometer and/or gyroscope sensor signals and estimating the gravity-to-magnetic toolface offset and/or the gyro-to-magnetic tool face offset. Magnetometer data is well suited for this because it is not directly affected by vibration, because they are no inertial sensors. The synchronicity of the different sensor signals (magnetic signals, and accelerometer and/or gyroscope signals) is achieved by mechanically mounting the magnetometer, the accelerometer and/or the gyroscope sensors on the same rotating part so that the sensors rotate together (same rotation axis) and by ensuring same or overlapping measurement time intervals and same time resolution. Non synchronous data may undergo a conditioning step to condition input data for the tool face demodulation filter.

The synchrodyne demodulator shifts the modulation data (i.e., accelerometer or gyroscope data) down to frequency zero. After application of a suitable low-pass filter, only the constant part of the demodulated data is left. The demodulated data contains the amplitude and phase of the modulation data. If the modulation data is accelerometer data, the resulting amplitude corresponds to the gravitational field in the x-y plane (the x-y gravity), and the phase is the angle difference to magnetic toolface, which is the gravity-to-magnetic toolface offset 74.

If the modulation data is gyroscope data, the resulting amplitude corresponds to the earth rotation rate in the x-y plane (the x-y earth rate), and the phase is the angle difference to magnetic toolface, which is the gyro-to-magnetic toolface offset 72. The TF demodulation filter performs a correction of the gyroscope data and/or the accelerometer data using the magnetometer data to provide a reliable detection of the instantaneous angle information of the rotation about the z-axis of the borehole string 12 and/or the sleeve 34. The correction performed in the TF demodulation filter includes a demodulation of the oscillating gyroscope data, a bias removal from the gyroscope data and the accelerometer data, and/or a noise reduction of the magnetometer data, the gyroscope data and accelerometer data. Demodulating the gyroscope data and the accelerometer data includes substantial removal of the AC signal components and determining of the x-y earth rate, the gyro-to-magnetic tool face offset (phase of gyroscope data), the x-y gravity and the gravity-to-magnetic toolface offset (phase of accelerometer data). It is to be mentioned that demodulating the oscillating gravity gyroscope data and the oscillating accelerometer data on basis of the oscillating magnetometer data does not require a full 360 degree rotation about the rotational axis. Detection of the rotation of smaller angles are sufficient. Smaller angles may be rotation of ¾ of a full rotation (270 degree), rotation of ½ of a full rotation (180 degree), rotation of ¼ of a full rotation (90 degree), or rotation of less than ¼ of a rotation.

In a different approach, the three gyroscope and three magnetometer readings can be combined to a set of directional information. When adding information regarding latitude and inclination, true north azimuth based on Gyro-x-y and true north toolface values while drilling can be derived.

At block 83, the gravity-to-magnetic toolface offset 74 and the gyro-to-magnetic toolface offset 72 are joined together to estimate an effective offset between the gravity toolface and the gyro toolface, referred to as the "gyro-to-gravity toolface offset" 75. This is independent from magnetic interference, as the magnetic toolface is influenced in both primary offset values in the same way and compensates.

In one embodiment, at block 84, the gyro-to gravity toolface offset 75 is joined with input information including inclination (INC) and latitude (LAT) in order to derive the true north azimuth direction. This results in a true-north azimuth (azimuth direction to true north) that is based on the gyro-to-gravity toolface offset (block 85). The true-north azimuth value may be associated with "exclusion zones," or areas having increased inaccuracy relative to other zones. At block 85, the true-north azimuth value has exclusion zones around the east and west directions for large inclination values (e.g., close to a horizontal borehole trajectory).

An example of an implementation of the true north azimuth calculation is:

$$Azi_{TFO} = a\sin\left(\frac{\sin(LAT)\sin(INC)\sin(GTG)}{\cos(LAT)\sqrt{1-\sin^2(GTG)\sin^2(INC)}}\right) - a\tan\left(\frac{\cos(GTG)}{\cos(INC)\sin(GTG)}\right),$$

where "GTG" is the gyro-to-gravity toolface offset 75 (FIG. 4).

In one embodiment, magnetic measurements are utilized to correct gyroscope measurements in the z-axis ("Gyro-z data). At block 86, the system acquires the Gyro-z data and the magnetic toolface calculated above, and derives the earth rate component in the z-direction (the "z-earth rate"), which can be used for north-finding.

At block 87, the z-earth rate is calculated by taking a time derivative of the magnetic toolface. The time derivative of the magnetic toolface (MTF) (corresponding to rotational rate of the drill string or sleeve) and the z-axis gyroscope measurements are combined and input to a rate filter. At block 88, the rate filter calculates the rotational rate of the sleeve 32 (or borehole string 12) about the rotational axes detected by the magnetometer (based on MTF) and the z-gyroscope (Gyro-z data). The rate filter calculates the difference of the rotational rate detected by the magnetometers and the gyroscope. The difference is used to determine the z-earth rate. The rate filter outputs the z-component of the earth rate, i.e., the z-earth rate. The rate filter may also perform a noise reduction step applied to the Gyro-z data and/or the magnetic data (MTF). It is noted that in a rotating system, this task is challenging as the string rotation and related noise is orders of magnitude higher than the useful quasi-constant signal. The rotation and related vibration reduces dramatically when the sensor assemblies 40 are mounted e.g. on the slowly-rotating part of a rotary steerable system (e.g., the sleeve 34), which results in more reliable derivation of the z-earth rate value.

In one embodiment, at block 89, the z-earth rate data is combined with input information including the inclination (INC), the latitude (LAT) and the earth rotation rate (EROT), in order to derive the true north azimuth direction while drilling (block 90). The EROT is the full earth rotation rate which is constant and known. The EROT can be derived through the root sum square of the gyro-to-gravity toolface offset 75 (from block 83) and the z-earth rate (from block 88). Such a derivation can be used and compared to the known EROT as part of a downhole data quality check.

This results in a true-north azimuth value that is based on the Gyro-z data. At block 90, the true-north azimuth may have exclusion zones around the north and south directions for large inclination values (e.g., close to horizontal). An example of an implementation of the azimuth calculation is:

$$Azi_Z = \pm a\cos\left(\frac{Gyro_Z - EROT\sin(LAT)\cos(INC)}{EROT\cos(LAT)\sin(INC)}\right).$$

Additional logic may be used to derive the correct sign of the true north azimuth. Different options are available. As drilling progress and turn rates are typically not abrupt, a previously acquired static survey information can be used. Close to the sign transition zone, the azimuth derived from the gyro-to-gravity toolface offset 75 ($Azi_{TFO}$) can be used to derive the sign. Alternatively, additional information is provided by other sensors or downhole tools (such as imaging tools, or other directional tools) located in the borehole string 12.

At block 91, the gyro-to-gravity toolface offset (x-y earth rate, x-y gravity) is combined with the z-earth rate 88 from the Gyro-z data and accelerometer data in the z-direction 78 (referred to as "Accel-z")) to derive true-north azimuth without exclusion zones. The Accel-z data 78 may be passed through a lowpass filter 79 to remove noise due to vibration. The Accel-z data provides the inclination which is not derived in steps 81-83 and/or steps 86-88. The combining results in an estimation of true north azimuth (block 92). In one embodiment, a fusion filter is used to combine the gyro-to-gravity toolface offset 75 and the z-earth rate data to generate the true-north azimuth. Examples of suitable filters include a Kalman (linear quadratic estimation) filter, an extended Kalman filter (EKF) and an unscented Kalman filter (UKF).

In the embodiment of FIG. 3, the derivative of the magnetic toolface (MTF) is used and compared to the rotational rate derived from the magnetic toolface to estimate the z-earth rate.

Figure 5:
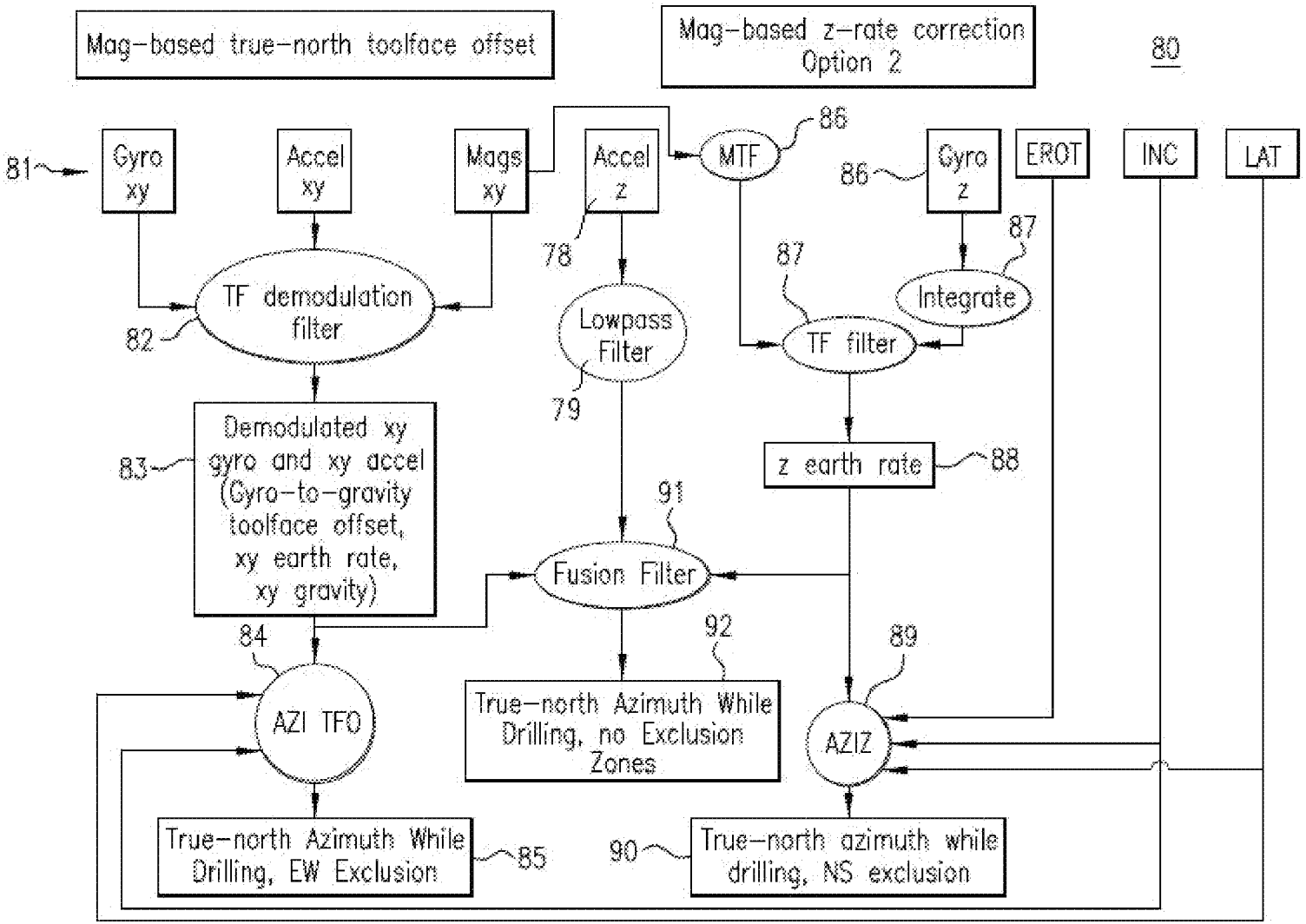
FIG. 5 is a flow chart that depicts another embodiment of the method of FIG. 3.

FIG. 5 shows another embodiment of the method 80. This embodiment is similar to the embodiment of FIG. 3, except the stage at block 87 includes integrating the Gyro-z data and comparing the Gyro-z data to the MTF to derive the z-earth rate.

Gyroscopes used for north-finding in MWD are typically bias-corrected through so-called "indexing" or "carouseling". Depending on the type and quality of the used gyroscope, it can be assumed that the bias is (i) negligible, (ii) corrected through "indexing" or "carouseling" during stationary measurements, or (iii) derived and/or compensated for using the tool rotation in the demodulation filter. Processing gyroscope data while rotation as shown in FIGS. 3 and 5 has a bias removal included in the TF demodulation filter.

Bias removal or accounting for an unknown gyro bias can be accomplish in a number of ways. For example, a classical indexing mechanism can be used to rotate sensors and estimate the bias during standstill. The estimated bias may be used during preprocessing. In this example, no minimum rotation speed is needed while drilling. The example is useful, e.g., if there is good bias stability of the gyro sensor over time.

In another example, sensors are disposed at the slowly rotating sleeve or other slowly rotating component. The sleeve rotation is used as a natural replacement for the indexing mechanism to determine the bias. The estimated bias may be used during preprocessing. The methods described herein makes it possible to deal with the slow rotation during data acquisition. Minimum speed of the slow sleeve rotation is dependent on, e.g., the bias stability of the gyro. For example, if the bias drifts out of spec in a time frame of a given length, the sleeve should make about one revolution during a time equal to the length of the time frame.

In a further example, sensors are fixed to and rotate with a drill string. Input data for the processing may have considerable bias which is not fully removed by preprocessing. In this case, bias is removed or compensated for as a side effect of the demodulation method discussed above. In this example, a minimum drill string rotation speed is used in order to ensure that bias compensation occurs as a result of the demodulation.

The following is a description of an example of the method 80 that utilizes demodulation. In this example a synchrodyne demodulator (e.g., the TF filter of FIG. 5) is used as part of the method 80.

Input data are sampled data from cross-axial (x-y) magnetometers as well as cross-axial accelerometers. Data is again sampled from cross-axial gyroscopes and the magnetometers. Results of the both samplings are combined.

The cross-axial accelerometer samples are denoted $g_{xi}$ and $g_{yi}$. y and x denote the axes, and i is a sample index. The cross-axial magnetometer samples are denoted $h_{xi}$ and $h_{yi}$.

This data may be preprocessed by various preprocessing steps, such as low-pass filtering (anti-aliasing and/or denoising) and/or correction (compensation of bias, scale, nonlinearity and misalignment errors, each of which may be temperature dependent). The gyroscope bias (gyro bias) may be estimated from indexing or slow sleeve rotation. The preprocessing may be implemented in hardware or software. An example of a sample rate of the preprocessed data is in the range of about 10 Hz to a few kHz.

The synchronicity of the different sensor signals (magnetic signals, and accelerometer and/or gyroscope signals) is achieved as discussed above. All data with the same index i is representative of the same time frame.

Cross-axial magnetometer and accelerometer signals are then interpreted as analytic (i.e. complex) signals where, for example. the x-axis signal is the real component and the y-axis signal is the imaginary component. For example, the imaginary component of gravity field measurements is denoted as $g_{imag\ i}$, and the real component is denoted as $g_{real\ i}$. Interpreted as magnitude and phase, the complex signals show constant magnitude and increasing phase during rotation. The accelerometer and gyroscope data is affected by drilling noise while the magnetometer signal is clean. From the fixed mechanical coupling between accelerometers, gyroscopes and magnetometers, the phases of noise free accelerometer data, gyroscope data and magnetometer data have a fixed offset during rotation (which is azimuth/inclination dependent).

An example of equations for processing the data include:

$$h_{xyi}=\sqrt{h_{xi}^2+h_{yi}^2} \quad \text{Eq.1}$$

$$h_{xyi}g_{real\ i}=g_{xi}h_{xi}+g_{yi}h_{yi} \quad \text{Eq.2}$$

$$h_{xyi}g_{imag\ i}=g_{xi}h_{yi}+g_{yi}h_{xi} \quad \text{Eq.3}$$

or anything mathematically equivalent. The equations are not limited to this example. For example, the equations include those that are mathematically equivalent to the above, but conformed to different conventions for different sensor axes if such conventions are used.

$h_{xyi}$ denotes the magnitude of the cross-axial magnetic field, which can be calculated directly because the magnetometers are not affected by drilling noise. The magnetic field $h_{xyi}$ can be calculated in a variety of different ways and is not limited to the above example. Calculation of $h_{xyi}$ is optional, for example, if only the toolface offset is calculated.

To calculate the correctly scaled cross-axial gravity field, $g_{real\ i}$ and $g_{imag\ i}$ are calculated by dividing by $h_{xyi}$ as shown in the above equations. $h_{xyi}$ may also be included in the azimuth equation. Additional filtering may be applied to $h_{xyi}$ before it is used to calculate $g_{real\ i}$ and $g_{imag\ i}$ or the azimuth.

The results $g_{real\ i}$ and $g_{imag\ i}$ are then low-pass filtered to get rid of unwanted frequency components. The results $g_{real\ i}$ and $g_{imag\ i}$ form a complex number which can also be interpreted in polar coordinates as magnitude and phase. Alternatively, a low-pass filter can be applied to the magnitude and/or phase components.

The complex magnitude of the filtered result is the magnitude of the cross-axial gravity field and the complex phase is the phase difference between gravity and magnetic field measurements ("gravity-to-magnetic toolface offset").

The "gyro-to-magnetic toolface offset" is calculated in a similar fashion. For example, the gyro-to-magnetic toolface offset is calculated using the above equations, where gxi and gyi are replaced with corresponding gyroscope measurements.

The two toolface offsets can then be combined into the gyro-to-gravity toolface offset, eliminating the magnetic toolface from the result.

In this example, the slow rotation is at or above a minimum rotation speed. The minimum rotation speed can be determined, e.g., based on the acquisition window of the low-pass filter applied to the results $g_{real\ i}$ and $g_{imag\ i}$. For example, if the low-pass filter is an averaging filter averaging 1000 samples taken at 100 Hz, the relevant time frame would be 10 seconds. In this time frame the downhole component should cover e.g. at least one full revolution, leading to a 6 rpm average minimum speed in this example.

The above example is applied to a slow rotating component, but can also be applied to a component or tool that is stationary (not rotating). This result would be impacted by bias errors of the gyro and accelerometer sensors.

Figure 6:
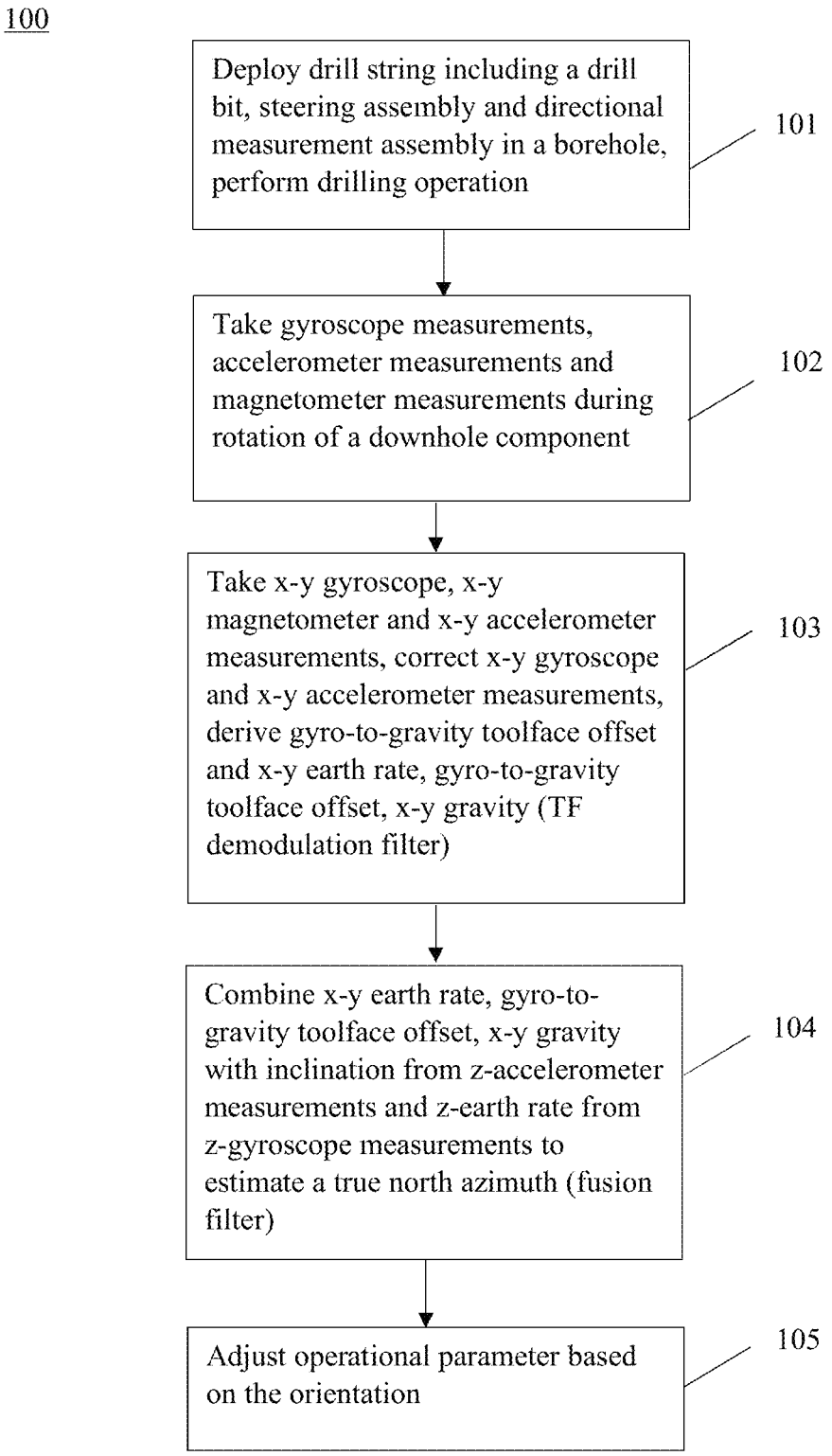
FIG. 6 is a flow chart that depicts an embodiment of a method of performing aspects of an energy industry operation and estimating directional parameters of a downhole component.

FIG. 6 illustrates a method 100 of performing an energy industry operation and estimating directional parameters of components of a borehole string. The method 100 may be performed in conjunction with the system 10, but is not limited thereto. The method 100 includes one or more of stages 101-105 described herein, at least portions of which may be performed by a processor (e.g., the downhole processor 48). In one embodiment, the method 100 includes the execution of all of stages 101-105 in the order described. However, certain stages may be omitted, stages may be added, or the order of the stages changed.

In the first stage 101, an energy industry operation is performed using one or more rotating components. For example, the string 12 is operated to drill a section of the borehole as part of a directional drilling operation, which includes steering or directing the drill bit 24 using the steering assembly 32.

In the second stage 102, during a component rotation, gyroscopic measurements are performed by a gyroscope device 60 disposed at the component and configured to rotate with the component. In one embodiment, gyroscope measurements are taken by a gyroscope device disposed on a slow rotating sleeve, such as the sleeve 34. Alternatively, if the gyroscope device 60 is disposed on a component that rotates with the drill bit 26, measurements may be performed during a slow rotation mode.

In the third stage 103, measurements are performed by a magnetometer device 64, and magnetometer measurements are combined with gyroscope measurements to correct errors in the gyroscope measurements as discussed above. In one embodiment, measurements are performed by an accelerometer device 62, which may be combined with the magnetometer measurements to correct the accelerometer measurements. The gyroscope measurements, accelerometer measurements and the magnetic measurements may be performed at the same time or within a selected time frame. Measurements may be performed substantially continuously (e.g., according to a selected sampling rate), periodically or according to any other schedule.

In the fourth stage 104, the above measurements are combined to estimate various directional parameters. For example, the combined measurements are used to estimate true north toolface, true north and true north azimuth as discussed above. Inclination can also be estimated using the corrected accelerometer measurements.

In the fifth stage, 105 operational parameters of an energy industry operation are controlled or adjusted based on the directional parameters. For example, the steering assembly 32 is operated during drilling based on the directional measurements to steer the drill bit 24 along a desired path.

In one embodiment, the directional information gathered during drilling operation (string rotation) as discussed above can be combined with directional data from static survey stations (e.g., during stand-still, off-bottom). Static survey stations are typically used when adding drill pipe to the string, when the drill string is suspended in so-called "slips" in the rotary table. Measurements gathered during stand-still can be less noisy, especially total-field values and the local dip value, which can be used to derive directional information, especially azimuth.

In one embodiment, directional data including true north from gyroscopic measurements and magnetometer measurements is gathered during static surveys (e.g., when a borehole string or drill string is in stand-still or sliding mode) and combined with directional information gathered during rotation. Static true north and magnetometer measurements can be used to derive the relative azimuth of the current orientation during the drilling progress (e.g., by combining toolface data with the static measurements). Combining the two leads to accurate directional information during stationary surveys and during drilling.

Determining x-y earth rate data while rotating from x-y gyroscope (Gyro-x-y) data, x-y magnetometer data (Mags-x-y) and x-y accelerometer (Accel-x-y) data, by demodulating the x-y gyroscope data and the x-y accelerometer data based on the x-y magnetometer data in a TF demodulation filter (see block 82) is not known in the prior art. The determined x-y earth rate combined with inclination data and latitude data derived from other sources, may be used to provide directional parameters of a borehole string or a steering assembly and/or to control a borehole operation (e.g. directional drilling).

Using a fusion filter (see block 91) to combine the x-y earth rate data while rotating provided by the TF demodulation filter, z-earth rate data (block 88) acquired while rotating, and inclination data derived from Accel-z data (see block 79) while rotating is also not known in the prior art. All measurement data (gyroscope, magnetometer, accelerometer) used by the TF demodulation filter and the fusion filter may be acquired while rotating the borehole string 12 and/or the sleeve 34. Input data to the TF demodulation filter and the fusion filter are gyroscope data, magnetometer data and accelerometer data. Using the fusion filter eliminates the input of inclination (INC), latitude (LAT), or total earth rate (EROT) provided by other sensors or other sources. The true north azimuth determined by the fusion filter is without exclusion zones.

The presented method can be performed real time while drilling. The derived true north azimuth may be used for automated borehole operation, such as automated drilling a predetermined borehole trajectory (azimuth hold mode). The true north azimuth data may be transmitted to surface by using telemetry techniques, such as mud pulse telemetry or wired pipe. Alternatively, the gyroscope, magnetometer and accelerometer data may be transmitted to surface to perform the calculation of the true north azimuth at surface.

Set forth below are some embodiments of the foregoing disclosure:

Embodiment 1: A method of estimating a directional parameter of a downhole component, comprising: deploying a borehole string in a borehole, the borehole string including the downhole component, the downhole component being rotatable, the downhole component including a gyroscope device and a magnetometer device; collecting gyroscope measurement data from the gyroscope device and magnetic field measurement data from the magnetometer device during rotation of the downhole component; and estimating, by a processor, the directional parameter of the downhole component, wherein the estimating includes correcting the gyroscope measurement data based on the magnetic field measurement data.

Embodiment 2: The method as in any prior embodiment, wherein the directional parameter is a true north azimuth.

Embodiment 3: The method as in any prior embodiment, wherein the gyroscope measurement data include x-y gyroscope measurement data, and the magnetic field measurement data include x-y magnetic field measurement data, wherein a plane defined by x and y is perpendicular to a longitudinal axis of the downhole component.

Embodiment 4: The method as in any prior embodiment, wherein the correcting includes demodulating the x-y gyroscope measurement data using the x-y magnetic field measurement data, and wherein the estimating includes calculating a x-y earth rate.

Embodiment 5: The method as in any prior embodiment, wherein the gyroscope measurement data include z-gyroscope measurement data, wherein z is perpendicular to the plane defined by x and y.

Embodiment 6: The method as in any prior embodiment, wherein estimating includes calculating a z-earth rate using the z-gyroscope measurement data.

Embodiment 7: The method as in any prior embodiment, wherein the x-y gyroscope measurement data and the x-y magnetic field measurement data are acquired while rotating the downhole component slower than about 300 degree/min.

Embodiment 8: The method as in any prior embodiment, further comprising collecting x-y-accelerometer measurement data.

Embodiment 9: The method as in any prior embodiment, wherein the correcting includes demodulating the x-y-accelerometer measurement data using the x-y magnetic field measurement data, and wherein the estimating includes calculating a x-y earth rate.

Embodiment 10: The method as in any prior embodiment, wherein the estimating includes calculating a true north azimuth using the x-y earth rate, an inclination and a latitude.

Embodiment 11: The method as in any prior embodiment, wherein the estimating includes calculating a z-earth rate using z-gyroscope measurement data, wherein z is perpendicular to the plane defined by x and y.

Embodiment 12: The method as in any prior embodiment, wherein the estimating further includes using a filter, wherein the filter calculates a true north azimuth using the x-y earth rate, the z-earth rate and an inclination.

Embodiment 13: The method as in any prior embodiment, wherein the inclination is determined using z-accelerometer measurement data.

Embodiment 14: The method as in any prior embodiment, wherein the filter is a Kalman filter.

Embodiment 15: The method as in any prior embodiment, wherein the downhole component is a rotary steering assembly comprising a slowly rotating sleeve, wherein the sleeve comprises the gyroscope device and the magnetometer device.

Embodiment 16: A system for estimating a directional parameter of a downhole component, comprising: a borehole string, the borehole string comprising the downhole component, the downhole component being rotatable, the downhole component including a gyroscope device and a magnetometer device; and a processor configured to perform: collecting gyroscope measurement data from the gyroscope device and magnetic field measurement data from the magnetometer device during rotation of the rotatable downhole component; and estimating the directional parameter of the downhole component, wherein the estimating includes correcting the gyroscope measurement data based on the magnetic field measurement data.

Embodiment 17: The system as in any prior embodiment, wherein the downhole component includes a rotary steering assembly having a sleeve configured to be rotated relative to the borehole string, and the sleeve is configured to rotate at a rate that is less than a rotational rate of the borehole string.

Embodiment 18: The system as in any prior embodiment, wherein the sleeve includes a plurality of pads extendable to control a direction of at least a drill bit of the borehole string.

Embodiment 19: The system as in any prior embodiment, wherein the correcting includes: demodulating the gyroscope measurement data using the magnetometer measurement data and wherein estimating includes calculating an x-y earth rate, wherein a plane defined by x and y is perpendicular to a longitudinal axis of the downhole component.

Embodiment 20: The system as in any prior embodiment, wherein the estimating includes calculating a true north azimuth of the downhole component.

Embodiment 21: The system as in any prior embodiment, wherein the downhole component includes an accelerometer device, and the processing device is configured to perform: collecting accelerometer measurement data from the accelerometer device, and correcting the accelerometer measurement data by demodulating the accelerometer measurement data using the magnetometer measurement data.

Embodiment 22: The system as in any prior embodiment, wherein the estimating includes a Kalman filter, wherein the Kalman filter calculates a true north azimuth using the x-y earth rate, a z-earth rate and an inclination.

In connection with the teachings herein, various analyses and/or analytical components may be used, including digital and/or analog subsystems. The system may have components such as a processor, storage media, memory, input, output, communications link (wired, wireless, pulsed mud, optical or other), user interfaces, software programs, signal processors and other such components (such as resistors, capacitors, inductors, etc.) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user, or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. A method of estimating a directional parameter of a downhole component, comprising:

deploying a rotatable borehole string in a borehole, the borehole string including the downhole component, the downhole component being rotatable with the borehole string, the downhole component including a gyroscope device and a magnetometer device;

collecting gyroscope measurement data from the gyroscope device and oscillating magnetic field measurement data from the magnetometer device during rotation of the gyroscope device and the magnetometer device with the borehole string; and estimating, by a processor, the directional parameter of the downhole component, wherein the estimating includes correcting the gyroscope measurement data to remove an oscillating signal component from the gyroscope measurement data using the oscillating magnetic field measurement data, the oscillating signal component from the gyroscope measurement data and the oscillating magnetic field measurement data related to the rotation of the borehole string.

2. The method of claim 1, wherein the directional parameter is a true north azimuth.

3. The method of claim 1, wherein the gyroscope measurement data include x-y gyroscope measurement data, and the oscillating magnetic field measurement data include x-y magnetic field measurement data, wherein a plane defined by x and y is perpendicular to a longitudinal axis of the downhole component.

4. The method of claim 3, wherein the correcting includes demodulating the x-y gyroscope measurement data using the x-y magnetic field measurement data, and wherein the estimating includes calculating a x-y earth rate.

5. The method of claim 4, wherein the demodulating includes removing the oscillating signal component from the x-y gyroscope measurement data using a demodulator.

6. The method of claim 3, wherein the gyroscope measurement data include z-gyroscope measurement data, wherein z is perpendicular to the plane defined by x and y.

7. The method of claim 6, wherein the estimating includes calculating a z-earth rate using the z-gyroscope measurement data.

8. The method of claim 3, wherein the x-y gyroscope measurement data and the x-y magnetic field measurement data are acquired while rotating the downhole component slower than about 300 degree/min.

9. The method of claim 3, further comprising collecting x-y-accelerometer measurement data.

10. The method of claim 9, wherein the correcting includes demodulating the x-y-accelerometer measurement data using the x-y magnetic field measurement data, and wherein the estimating includes calculating a x-y earth rate.

11. The method of claim 10, wherein the estimating includes calculating a true north azimuth using the x-y earth rate, an inclination and a latitude.

12. The method of claim 10, wherein the estimating includes calculating a z-earth rate using z-gyroscope measurement data, wherein z is perpendicular to the plane defined by x and y.

13. The method of claim 12, wherein the estimating further includes using a filter, wherein the filter calculates a true north azimuth using the x-y earth rate, the z-earth rate and an inclination.

14. The method of claim 13, wherein the inclination is determined using z-accelerometer measurement data.

15. The method of claim 14, wherein the filter is a Kalman filter.

16. The method of claim 1, wherein the downhole component is a rotary steering assembly comprising a sleeve rotating with the borehole string at a rate that is less than a rotational rate of the borehole string, wherein the sleeve comprises the gyroscope device and the magnetometer device.

17. A system for estimating a directional parameter of a downhole component, comprising:

a rotatable borehole string, the borehole string comprising the downhole component, the downhole component being rotatable with the borehole string, the downhole component including a gyroscope device and a magnetometer device; and a processor configured to perform:

collecting gyroscope measurement data from the gyroscope device and oscillating magnetic field measurement data from the magnetometer device during rotation of the gyroscope device and the magnetometer device with the borehole string; and estimating the directional parameter of the downhole component, wherein the estimating includes correcting the gyroscope measurement data to remove an oscillating signal component from the gyroscope measurement data using the oscillating magnetic field measurement data, the oscillating signal component of the gyroscope measurement data and the oscillating magnetic field measurement data related to the rotation of the borehole string.

18. The system of claim 17, wherein the downhole component includes a rotary steering assembly having a sleeve configured to rotate with the borehole string at a rate that is less than a rotational rate of the borehole string, and the gyroscope device and the magnetometer device are located in the sleeve.

19. The system of claim 18, wherein the sleeve includes a plurality of pads extendable to control a direction of a drill bit of the borehole string.

20. The system of claim 17, wherein the correcting includes:

demodulating the gyroscope measurement data using the oscillating magnetic field measurement data and wherein estimating includes calculating an x-y earth rate, wherein a plane defined by x and y is perpendicular to a longitudinal axis of the downhole component.

21. The system of claim 20, wherein the downhole component includes an accelerometer device, and the processor is configured to perform: collecting accelerometer measurement data from the accelerometer device, and correcting the accelerometer measurement data by demodulating the accelerometer measurement data using the oscillating magnetic field measurement data.

22. The system of claim 20, wherein the estimating includes a Kalman filter, wherein the Kalman filter calculates a true north azimuth using the x-y earth rate, a z-earth rate and an inclination.

23. The system of claim 20, further comprising a demodulator configured to remove the oscillating signal component from the gyroscope measurement data.

24. The system of claim 17, wherein the estimating includes calculating a true north azimuth of the downhole component.

* * * * *